US007882971B2

(12) United States Patent
Kelley et al.

(10) Patent No.: US 7,882,971 B2
(45) **Date of Patent: *Feb. 8, 2011**

(54) RECTANGULAR CONTAINER WITH VACUUM PANELS

(75) Inventors: Paul V. Kelley, Thurmont, MD (US); Richard Ogg, Littlestown, PA (US); David Melrose, Aukland (NZ); Seungyeol Hong, York, PA (US); Jonh Denner, York, PA (US)

(73) Assignee: Graham Packaging Company, L.P., York, PA (US)

( * ) Notice: Subject to any disclaimer, the term of this patent is extended or adjusted under 35 U.S.C. 154(b) by 1457 days.

This patent is subject to a terminal disclaimer.

(21) Appl. No.: 11/298,473

(22) Filed: Dec. 12, 2005

(65) Prior Publication Data

US 2006/0151425 A1 Jul. 13, 2006

Related U.S. Application Data

(63) Continuation-in-part of application No. 10/727,042, filed on Dec. 4, 2003, now Pat. No. 6,974,047.

(60) Provisional application No. 60/430,944, filed on Dec. 5, 2002.

(51) Int. Cl.
*B65D 1/02* (2006.01)
*B65D 1/42* (2006.01)

(52) U.S. Cl. ..... 215/373; 215/381; 215/382; 215/383; 220/669; 220/675

(58) Field of Classification Search ..... 215/373, 215/379, 381–383, 900, 384; 220/675, 666, 220/669, 672, 673
See application file for complete search history.

(56) References Cited

U.S. PATENT DOCUMENTS

| | | | | |
|---|---|---|---|---|
| 3,367,380 | A * | 2/1968 | Dickey | 383/104 |
| 3,537,498 | A | 11/1970 | St. Amand | |
| 4,308,955 | A * | 1/1982 | Schieser et al. | 206/509 |
| 4,863,046 | A * | 9/1989 | Collette et al. | 215/381 |
| 4,877,141 | A | 10/1989 | Hayashi et al. | |
| 5,092,474 | A * | 3/1992 | Leigner | 215/381 |
| 5,158,817 | A * | 10/1992 | Krishnakumar | 428/36.92 |
| 5,165,557 | A | 11/1992 | Ota et al. | |
| 5,178,290 | A | 1/1993 | Ota et al. | |
| 5,199,588 | A | 4/1993 | Hayashi | |
| 5,222,615 | A | 6/1993 | Ota et al. | |
| 5,224,614 | A | 7/1993 | Bono et al. | |
| 5,238,129 | A | 8/1993 | Ota | |
| 5,337,909 | A | 8/1994 | Vailliencourt | |
| 5,350,078 | A | 9/1994 | Potts et al. | |
| 5,392,937 | A | 2/1995 | Prevot et al. | |
| 5,472,105 | A | 12/1995 | Krishnakumar et al. | |
| 5,758,790 | A | 6/1998 | Ewing, Jr. | |

(Continued)

FOREIGN PATENT DOCUMENTS

| | | |
|---|---|---|
| WO | WO 97/34808 | 9/1997 |

*Primary Examiner*—Sue A Weaver
(74) *Attorney, Agent, or Firm*—Knoble Yoshida & Dunleavy, LLC

(57) ABSTRACT

A thin-walled, non-round plastic container having a body portion with generally rectangular sidewalls and a base. The body portion having a label mounting area extending between an upper label bumper and a lower label bumper on at least two of the adjacent sidewalls. The label mounting area includes a vacuum panel on a first sidewall, and a plurality of ribs, which may be on a second sidewall.

17 Claims, 3 Drawing Sheets

U.S. PATENT DOCUMENTS 5,762,221 A 6/1998 Tobias et al.
5,803,289 A 9/1998 Brady
5,908,127 A * 6/1999 Weick et al. ..... 215/373
D420,919 S 2/2000 Ogg
6,036,037 A 3/2000 Scheffer et al.
6,044,997 A 4/2000 Ogg
6,257,433 B1 7/2001 Ogg et al.
6,273,282 B1 8/2001 Ogg et al.
6,277,321 B1 8/2001 Vailliencourt et al.
D447,411 S 9/2001 Lichtman et al.
6,347,717 B1 * 2/2002 Eberle ..... 215/381
6,575,321 B2 6/2003 Bourque et al.
6,739,467 B2 * 5/2004 Saito et al. ..... 215/384
6,974,047 B2 * 12/2005 Kelley et al. ..... 215/381
7,017,763 B2 * 3/2006 Kelley ..... 215/383
D533,782 S * 12/2006 Ogg et al. ..... D9/516
7,165,693 B2 * 1/2007 Oguchi et al. ..... 215/381
2003/0136754 A1 7/2003 Bourque et al.

* cited by examiner

RECTANGULAR CONTAINER WITH VACUUM PANELS

This application is a continuation-in-part of U.S. application Ser. No. 10/727,042 now U.S. Pat. No. 6,974,047, filed Dec. 4, 2003, which claims priority to U.S. provisional application No. 60/430,944, filed Dec. 5, 2002, each of which is incorporated by reference in its entirety.

BACKGROUND OF THE INVENTION

1. Field of the Invention

The present invention relates to hot-fillable containers. More particularly, the present invention relates to hot-fillable containers having vacuum panels.

2. Background

The use of blow molded plastic containers for packaging "hot-fill" beverages is well known. However, a container that is used for hot-fill applications is subject to additional mechanical stresses on the container that result in the container being more likely to fail during storage or handling. For example, it has been found that the thin sidewalls of the container deform or collapse as the container is being filled with hot fluids. In addition, the rigidity of the container decreases immediately after the hot-fill liquid is introduced into the container. As the liquid cools, the liquid shrinks in volume, which, in turn, produces a negative pressure or vacuum in the container. The container must be able to withstand such changes in pressure without failure.

Hot-fill containers typically comprise substantially rectangular vacuum panels that are designed to collapse inwardly after the container has been filled with hot liquid. However, the inward flexing of the panels caused by the hot-fill vacuum creates high stress points at the top and bottom edges of the vacuum panels, especially at the upper and lower corners of the panels. These stress points weaken the portions of the sidewall near the edges of the panels, allowing the sidewall to collapse inwardly during handling of the container or when containers are stacked together. See, for example, U.S. Pat. No. 5,337,909.

The presence of annular reinforcement ribs that extend continuously around the circumference of the container sidewall are shown in U.S. Pat. No. 5,337,909. These ribs are indicated as supporting the vacuum panels at their upper and lower edges. This holds the edges fixed, while permitting the center portions of the vacuum panels to flex inwardly while the bottle is being filled. These ribs also resist the deformation of the vacuum panels. The reinforcement ribs can merge with the edges of the vacuum panels at the edge of the label upper and lower mounting panels.

Another hot-fill container having reinforcement ribs is disclosed in WO 97/34808. The container comprises a label mounting area having an upper and lower series of peripherally spaced, short, horizontal ribs separated endwise by label mount areas. It is stated that each upper and lower rib is located within the label mount section and is centered above or below, respectively, one of the lands. The container further comprises several rectangular vacuum panels that also experience high stress point at the corners of the collapse panels. These ribs stiffen the container adjacent lower corners of the collapse panels.

Stretch blow molded containers such as hot-filled PET juice containers, must be able to maintain their function, shape and labelability on cool down to room temperature or refrigeration. In the case of non-round containers, this is more challenging due to the fact that the level of orientation and, therefore, crystallinity is inherently lower in the front and back than on the narrower sides. Since the front and back are normally where vacuum panels are located, these areas must be made thicker to compensate for their relatively lower strength.

SUMMARY OF THE INVENTION

The present invention provides an improved blow molded non-round plastic container, where an efficient vacuum absorption panel is placed on symmetrically opposing sidewalls, which sidewall is on the axis furthest from the center point. In contrast, on the axis closest to the center point, the symmetrically opposing sidewalls may be reinforced with ribs. In addition the design allows for improved dent resistance, reduces container weight and improves label panel support.

The design of the invention insures that the generally rectangular sides remain relatively flat which facilitates packing in box-shaped containers and the utilization of shelves when displayed in stores for retail sale. The containers may be resistant to bellying out, which renders them suitable for a variety of uses including hot-fill applications.

In hot-fill applications, the plastic container is filled with a liquid that is above room temperature and then sealed so that the cooling of the liquid creates a reduced volume in the container. The non-round hot-fill container of the present invention has four generally rectangular sides and a roughly rectangular base. The opposing sidewalls, having the greatest distance between them, contain the generally rectangular vacuum panels. These panels may be symmetrical to each other in size and shape. These panels have substantially curved upper and lower ends, as opposed to the substantially straight upper and lower ends. These sidewalls containing the vacuum panels may in addition contain one or more ribs located above or below the panels. These optional ribs may also be symmetric to ribs, in size, shape and number to ribs on the opposing sidewall containing the symmetric vacuum panel. The ribs have a rounded edge, which may point inward or outward relative to the interior of the container.

The vacuum panels may be selected so that they are highly efficient. See, for example, International Application No. PCT/NZ00/00019 (Melrose) where panels with vacuum panel geometry are shown.

Sidewalls not containing the vacuum panels have one or more ribs located in the label may be defined by an upper bumper and a lower bumper. The ribs can have either an outer or inner edge relative to the inside of the container. These ribs may occur as a series of parallel ribs. These ribs may be parallel to each other and the base. The number of ribs within the series can be either an odd or even. The number, size and shape of ribs may be symmetric to those in the opposing sidewall. Such symmetry enhances stability of the container.

Preferably, the ribs on the side not containing the vacuum panel may be substantially identical to each other in size and shape. The individual ribs can extend across the length or width the container. The actual length, width and depth of the rib may vary depending on container use, plastic material employed and the demands of the manufacturing process. Each rib is spaced apart relative to the others to optimize its and the overall stabilization function as an inward or outward rib. The ribs may be parallel to one another and preferably, also to the container base.

In addition, the novel design of the hot-fill container also provides for additional areas on the label mounting area for receiving an adhesive or for contact with a shrink wrap label, thereby improving the process for applying a label to the container.

The advanced highly efficient design of the side vacuum panels more than compensates for the fact that they offer less surface area than normal front and back panels. Employment of a thin-walled, super lightweight preform insures that a high level of orientation and crystallinity may be imparted to the entire package. This increased level of strength together with the rib structure and highly efficient vacuum panels provide the container with the ability to maintain function and shape on cool down, while at the same time utilizing minimum gram weight.

The arrangement of ribs and vacuum panels on adjacent sides within the area defined by upper and lower label bumpers allows the package to be further light weighted without loss of structural strength. The ribs may be placed on the weaker side and the panels may be placed on the more oriented side, which allows one to thin these sidewalls and achieve a lighter overall weigh. This configuration optimizes orientation and crystallinity. Further, this configuration of ribs and vacuum panel represents a departure from tradition.

The invention is a thin-walled, non-round plastic container having a body portion with generally rectangular sidewalls and a base. The base can be non-rounded and can include an elliptical base push up. The body portion includes a label mounting area extending between an upper label bumper and a lower label bumper on at least two of the adjacent rectangular sidewalls. The label mounting area includes a vacuum panel on a first sidewall, and a plurality of ribs, which may be on a second sidewall. The ribs and vacuum panels cooperate to maintain container shape upon filling and cooling of the container. The first and second sidewalls may have symmetrical opposing sidewalls. The vacuum panel can include an upper and a lower edge that are rounded or can be substantially generally oval.

The first sidewall containing the vacuum panel can have a width that is less than the width of a second sidewall. The first sidewall can further include one or a plurality of ribs, which can be positioned outside or within the vacuum panel.

The ribs on the second sidewall of the plastic container can be horizontal, vertical or diagonal. The ribs can be outwardly facing, inwardly facing, or a combination of inwardly and outwardly facing.

Exemplary containers can be, for example, generally oval or generally rectangular. The container can be hot-fillable and manufactured from PET.

These and various other advantages and features of novelty, which characterize the invention, are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE INVENTION

Figure 1:
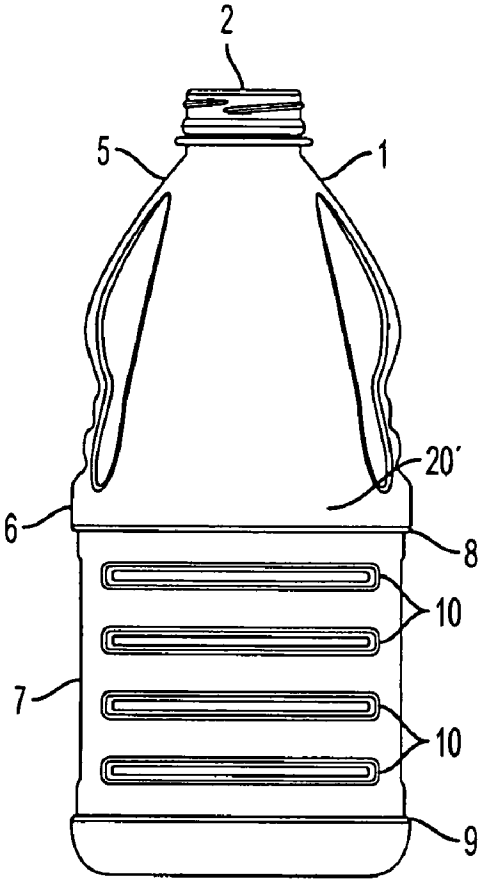
FIG. 1 shows a side view of the container along the longer base side showing the embodiment having a series of symmetrical ribs.

A thin-walled container in accordance with the present invention can be filled with a liquid at a temperature above room temperature in so-called hot-fill processing. In a hot fill process, a product is added to the container at an elevated temperature, about 82° C., which can be near the glass transition temperature of the plastic material, and the container is capped. As the container and its contents cool, the contents tend to contract and this volumetric change creates a partial vacuum within the container. In the absence of some means for accommodating these internal volumetric and barometric changes, containers tend to deform and/or collapse. In addition to these changes that adversely affect the appearance of the container, distortion or deformation can cause the container to lean or become unstable. This is particularly true where deformation of the base region occurs. As used herein, hot-fill processing includes conventional hot-fill techniques, as well as pasteurization and retort processing. The container can be filled by automated, high speed, hot-fill equipment known in the art.

Containers according to the present invention can have a one-piece construction and be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. For example, some plastic resins can be modified to improve the oxygen permeability. Alternatively, the container can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. Exemplary containers according to the present invention may be formed from a plastic material such as polyethylene terephthlate (PET) or other polyester.

Preferably, the container is blow molded by, for example, extrusion blow molding, stretch blow molding or injection blow molding. In extrusion blow molding, a molten tube of thermoplastic material, or plastic parison, is extruded between a pair of open blow mold halves. The blow mold halves close about the parison and cooperate to provide a cavity into which the parison is blown to form the container.

As formed, the container can include extra material, or flash, at the region where the molds come together, or extra material, or a moil, intentionally present above the container finish. After the mold halves open, the container drops out and is then went to a trimmer or cutter where any flash of moil is removed. The finished container may have a visible ridge formed where the two mold halves used to form the container came together. This ridge is often referred to as the parting line.

In stretch blow molding, a preformed parison, or preform, is prepared from a thermoplastic material, typically by an injection molding process. The preform typically includes a threaded end, which becomes the threads of the container. The preform is positioned between two open blow mold halves. The blow mold halves close about the preform and cooperate to provide a cavity into which the preform is blown to form the container. After molding, the mold halves open to release the container. Stretch blow molding is an exemplary method for forming containers according to the present invention. Injection blow molding is similar to stretch blow molding. In injection blow molding, a thermoplastic material is extruded through a rod into an inject mold to form a parison. The parison is positioned between two open blow mold halves. The blow mold halves close about the parison and cooperate to provide a cavity into which the parison is blown to form the container. After molding, the mold halves open to release the container.

Referring now to the drawings, embodiments of the container of this invention are indicated as generally having many of the well-known features of hot-fill containers. A shown in FIG. 1, non-round container 1, can have a substantially rectangular parallelepiped shape, having a longitudinal axis when the container is standing upright on its base. The container comprises a threaded neck 2 for filling and dispensing fluid. Neck 2 also is sealable with a cap (not shown). The illustrated container further comprises a base 4 and a shoulder 5 located below the neck 2 and above the base 4. The base is non-round and can be substantially rectangular (as illustrated), ovoid or other shapes. As used herein, geometric designations connoting straight sides and sharp corners include configurations where the sides are bowed inwardly (concave) or outwardly (convex) and where the corners are chamfered or rounded, so long as the shape is substantially as described geometrically. The container of the present invention also has a body 6 defined by roughly rectangular sides 20', 20" that connect shoulder 5 and base 4. At least one side of the preferred container has a label mounting area 7 located between an upper label bumper 8 and a lower label bumper 9. A label or labels can be applied to one or more of the label mounting areas, i.e. on a label mounting area of one or more sidewalls, using methods that are well known to those skilled in the art, including shrink wrap labeling and adhesive methods. As applied, the label can extend around the entire body of the container or extend over the entirety or a portion of label mounting area on one or more sides.

Figure 2:
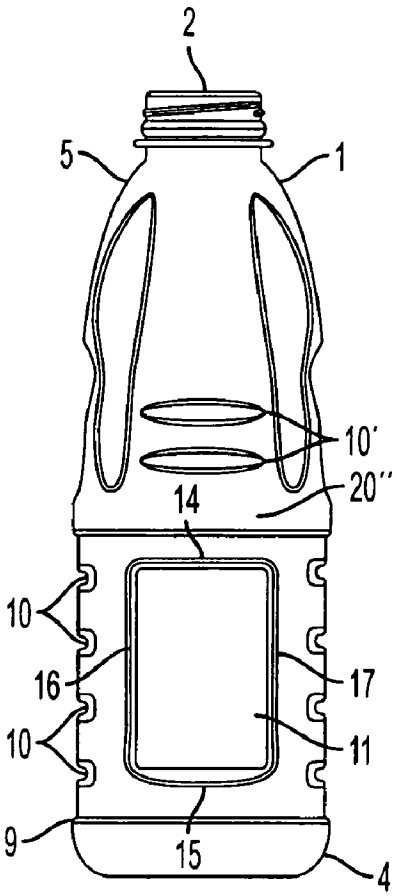
FIG. 2 shows a side view of the container along the shorter base side showing the side panel having a vacuum panel and the embodiment where there is a series of ribs positioned above the panel.
Figure 3:
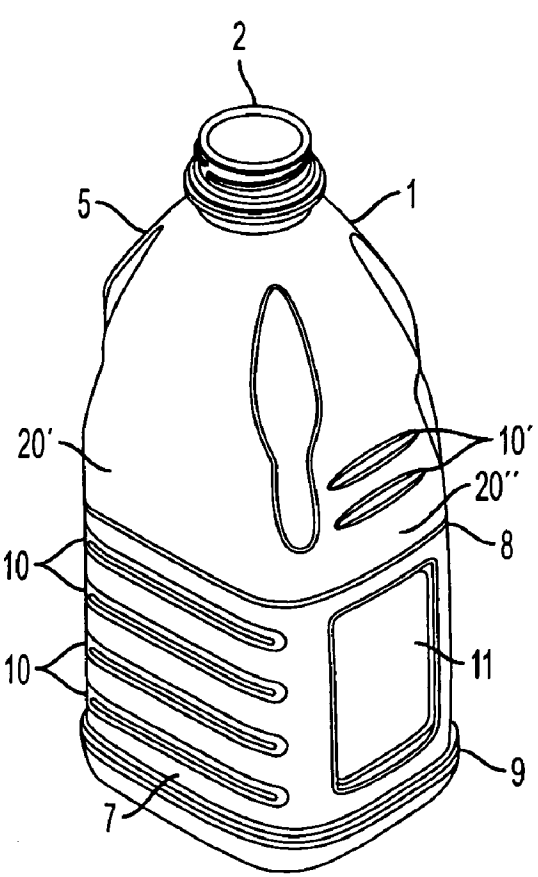
FIG. 3 shows a corner view showing adjacent sidewalls having respectively the vacuum panel and the rib structure.
Figure 4B:
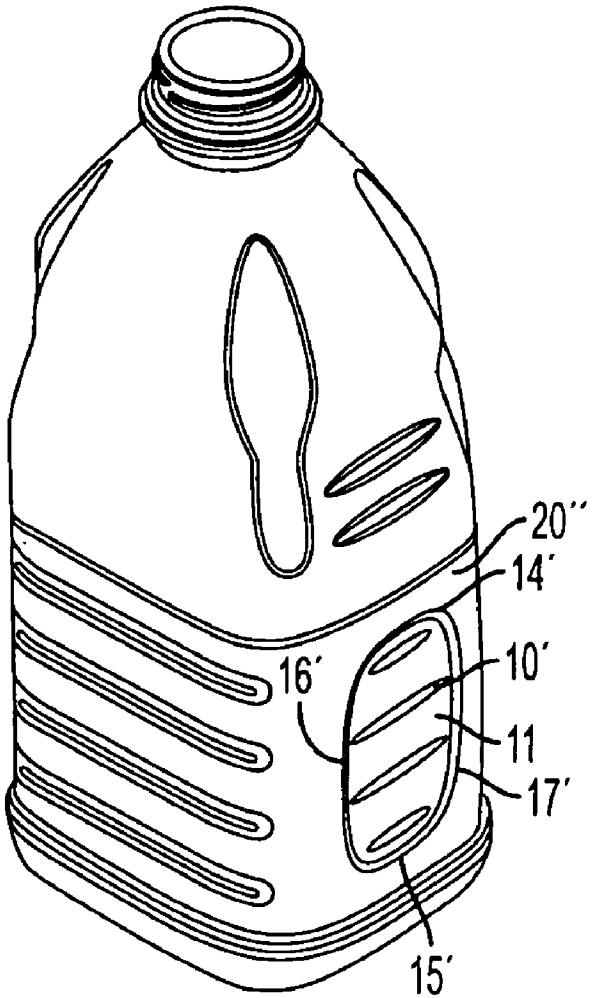
FIGS. 4A and 4B show alternative embodiments of the sidewall containing the vacuum panel.
Figure 4A:
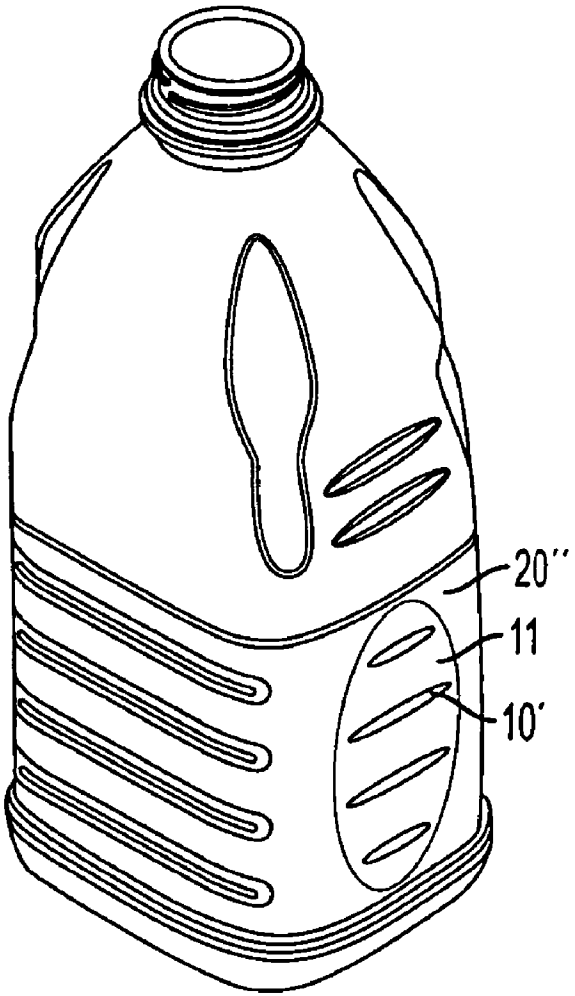

The substantially rectangular sidewalls include at least one first sidewall 20" having a vacuum panel 11 and at least one second sidewall 20' having one or more ribs 10. Generally, the substantially rectangular second sidewalls 20' containing one or more ribs 10 have a width greater than the first sidewall containing the vacuum panel 11. The first sidewalls 20" having the vacuum panels 11 are adjacent to those having the ribs 10 in the label areas defined by an upper and lower bumpers. Further, the first sidewalls 20" having the vacuum panels may also have one or more ribs 10'. As shown in FIGS. 2 and 3, the ribs 10' may be located above the upper label bumper 8. The one or more ribs 10' can be located in areas above and/or below the vacuum panels. As shown in FIGS. 4A and 4B, the one or more ribs 10' can alternatively be can be located within the vacuum panel 111 itself. In other embodiments, the vacuum panel can contain other structural features such as islands or label supports, as is generally known in the art and illustrated in, for example U.S. Pat. No. 5,178,289 to Krishnakumar, which is incorporated herein by reference in its entirety, or other texturing and stippling, etc, depending on the use of the container and subsequent processing. For example, in a container intended for hot-fill processing, additional structures can be present so long as such additional structures do not interfere with the ability of the vacuum panel to function in relieving internal vacuum that can develop during hot-fill processing. For containers intended for warm-fill or cold-fill that require less efficient vacuum accommodation, a greater variety of patterning or design options are possible in the vacuum panel.

The container can include a configuration of sidewalls containing vacuum panels 11 and ribs 10 and 10' such that opposing sidewalls are symmetrical. The vacuum panels 11" can have rounded edges 14, 14', 15, 15' or edgeless such that the vacuum panel blends into the surrounding sidewall, as shown in FIG. 4A. The vacuum panels 11 permit the bottle to flex inwardly upon filling with the hot fluid, sealing, and subsequent cooling. The ribs 10 and 10' can have a rounded outer or inner edge, relative to the space defined by the sidewalls of the container. The ribs 10 on the second sidewall 20' typically extend most of the width of the side and can be parallel with each other and the base. The width of these ribs is selected consistent with the achieving the rib function. The number of ribs 10 on the second sidewall can vary depending on container size, rib number, plastic composition, bottle filling conditions and expected contents. The first sidewall 20" containing ribs in the panel area can have an even number of ribs with an inner edge. The placement of ribs on the first or second sidewall can also vary so long as the desired goals associated with the interfunctioning of the ribs and the vacuum panels is not lost. More particularly, the combination and placement of ribs and vacuum panels provide the container with the ability to maintain function and shape on cool down and during use. For example, the ribs can be placed in other regions of the container such as the upper portion nearer the finish and on the "corners" of the rectangular container and/or additional vacuum panels can be present.

The ribs 10 on the second sidewall 20' generally function to stiffen the sidewall and prevent undesirable deformation of the sidewall during processing and use of the container. As used herein with respect to the ribs on the second sidewall, the term rib includes other structures or rib arrangements that achieve the desired rigidity of the container. The ribs on the second sidewall can face inwardly, i.e. the ribs are concave with respect to the exterior of the container and the indentation forming the ribs extends toward the interior of the container, or outwardly, i.e. the ribs are convex with respect to the exterior of the container and the indentation forming the ribs extends toward the exterior of the container. Alternatively, the second sidewall can contain a combination of inwardly facing and outwardly facing ribs.

The first sidewall 20" may also contain one or more ribs 10'. As shown in FIGS. 2, 3 and 6, the ribs on the first sidewall can be spaced apart from the upper and lower edges of the vacuum panels, respectively, and are placed to maximize their function. The ribs of each series can be noncontinuous, i.e., not touching each other, and can be placed so as not to touch a vacuum panel edge. These ribs can be parallel to the base and, where more than one are present, can be parallel to each other. These ribs generally have inward edges. Alternatively, as shown in FIGS. 4A and 4B, ribs 10' can be placed within the vacuum panel, so long as such placement does not inhibit performance of the vacuum panels.

The number of vacuum panels 11 is variable. However, two symmetrical panels, each on the opposite sides of the container, are preferred. The vacuum panel 11 illustrated in FIG. 1 is substantially rectangular in shape and has a rounded upper edge 14, a rounded lower edge 15, substantially straight rounded side edges 16 and 17, and a panel portion 11 that is intermediate the upper and lower edges. The upper edges of the vacuum panels are spaced apart from the upper label bumper 8 (or the upper label mount area) and the lower edge of the vacuum panels are spaced apart from the lower label bumper 9 (or the lower label mount area). The vacuum panels may be covered by the label once it is applied to the container. Alternatively, the vacuum panels may have other less rectangular shapes. For example, as shown in FIG. 4A, the vacuum panels may be bordered by curvilinear rather than straight lines and thus have a rounded oval shape rather than a rectangular shape. As another alternative, illustrated in FIG. 4B, the top edge 14' and bottom edge 15' as well as side edges 16' and 17', may be more bowed to provide a more rounded, but still generally rectangular shape.

As stated above, the edges of the vacuum panels 11 may be well defined (FIGS. 2, 3, 6B) or the vacuum panel may be substantially edgeless (FIG. 4A) such that the panel portion blends into the sidewall. The panel portion 11 may include ribs 10', texturing or other patterning, so long as such patterning does not interfere with the intended function of the vacuum panels. Thus, the configuration, appearance and design flexibility of the vacuum panels can vary depending on, for example, container size, rib number, plastic composition, bottle filling conditions and expected contents.

FIG. 2 shows the first sidewall 20" containing the vacuum panel in the label area along with a side view of a series of ribs, present on the adjacent sides in the label area. Also depicted in FIG. 2, are optional ribs, located above the vacuum panel. Of course, the number of ribs and optional ribs may vary, although it is preferred that the length and configuration of each rib is substantially identically to that of the remaining ribs of the series. It is also preferred that the ribs are positioned on a side so that they correspond in positioning and size to their counterparts on the opposite rectangular side of the container.

The corner view shown in FIG. 3 shows a preferred placement of the label area ribs relative to the side containing the vacuum panel and the optional ribs.

Figure 7:
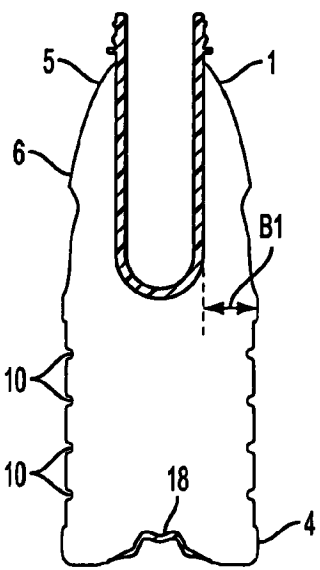
FIG. 7 is a sectioned view along the axis B-B shown in FIG. 5A, illustrating the rib cross sections.
Figure 8:
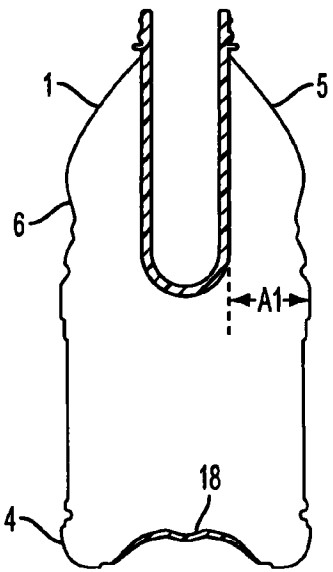
FIG. 8 is a sectional view along the axis A-A shown in FIG. 5B, illustrating the vacuum panel cross section.

As is known in the art, containers such as those according to the present invention can be configured to have a region of the base extending into the interior of the container, commonly referred to as a base push up, particularly when the container is used for hot fill applications. Generally, base push ups present in containers are circular. (See, for example, U.S. Pat. No. 4,108,324 to Krishnakumar which is incorporated herein by reference in its entirety.) As best illustrated in FIGS. 7 and 8, containers according to the present invention can have a non-circular base push-up 18. The base push up 18 of the illustrated embodiment can have a major and a minor axis and thus be elliptical or oval in shape. As illustrated, the minor axis of the elliptical base push up 18 is parallel to the first, vacuum panel containing sidewall and the major axis of the elliptical base push up 18 is parallel to the second, rib containing sidewall. (See FIG. 8.) Elliptical base push ups thus configured can offer several advantages in non-round, e.g. rectangular containers. For example, material distribution during the manufacture of containers having such elliptical push ups is improved as it more nearly matches the exterior contour of the container. Further, in containers having non-round or rectangular bases, elliptical push ups result in more efficient functionality, resulting in a container that is less prone to base roll out and better able to maintain stability when resting on a flat surface.

Figure 6B:
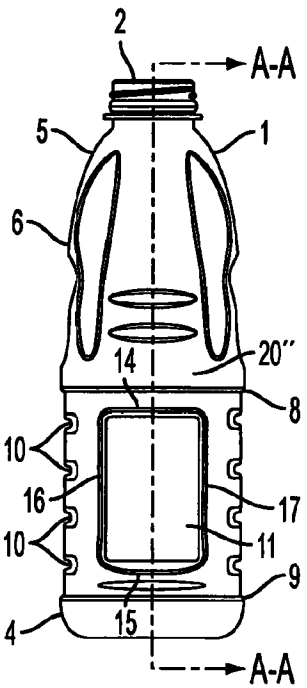
FIGS. 6A and 6B show a front and side view, respectively, for one embodiment of the container and provides dimensions for that embodiment. Also shown is an A-A axis and a B-B axis, respectively.
Figure 6A:
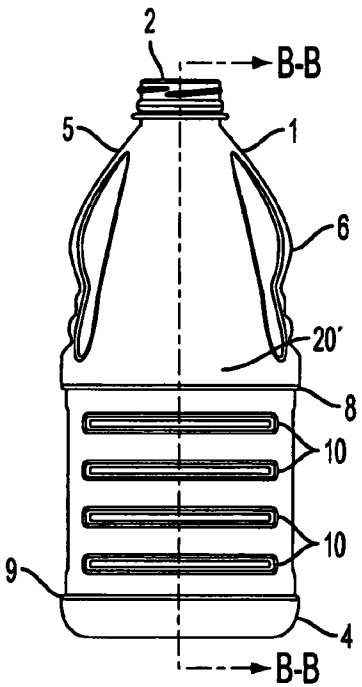

For a 64-ounce plastic container having an outer perimeter of approximately 414 mm and as depicted in FIGS. 6A and 6B, the vertical length of the vacuum panels is approximately 77 mm and the width of the panel is approximately 55 mm. The height of the depicted container is about 262 mm. The length and width of the base are, respectively, about 118 mm by about 89 mm. The depicted ribs have a length of 95 mm and width of approximately 9 mm. The depicted distance between adjacent ribs is approximately 13 mm, as measured from the respective inner edges. The depth of the depicted ribs in the label area is approximately 3 mm. The distance from the outer edge of upper most rib to the outer edge of the lowest rib, as depicted on the front side of the container, is approximately 74 mm.

Figure 5:
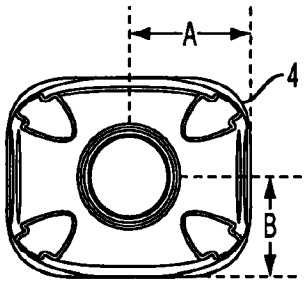
FIG. 5 shows a top view of the container of FIG. 1 showing dimension A and dimension B. Dimension A is the distance from the center point of the base to the sidewall containing the vacuum panel within the label area. Dimension B is the distance from the center point of the base to the sidewall containing the rib structures within the label area.

The part can be non-round in such a way that the face with the ribs Dimension B (see FIG. 5) from the center must be smaller than the face with the vacuum panel Dimension A (see FIG. 5) from the center (the most common geometry would be rectangular). The corresponding preform will be closer to the sidewall at Dimension B1 (see FIG. 7) than at the sidewall dimension A1 (see FIG. 8). This creates the setup in where in blow molding the preform into the bottle creates the different level of orientation.

The above is offered by way of example only, and the size of the reinforcement rib is a function of the size of the container, and would be increased from the values given in proportion to an increase in the dimensions of the container from the dimensions given for container 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

All references cited in this specification are hereby incorporated by reference. The discussion of the references herein is intended merely to summarize the assertions made by their authors and no admission is made that any reference constitutes prior art relevant to patentability. Applicants reserve the right to challenge the accuracy and pertinency of the cited references.

We claim:

1. A thin-walled, plastic container comprising a non-round body portion, said body portion having generally rectangular sidewalls, and a base wherein said body portion comprises a label mounting area, extending between an upper label bumper and a lower label bumper on at least two of the adjacent rectangular sidewalls, a first plurality of ribs, said label mounting area comprising:

a vacuum panel on a first sidewall, wherein the first plurality of ribs are located above the upper label bumper and further wherein there are no ribs located below the upper label bumper on the first sidewall; and a second plurality of ribs, wherein the second plurality of ribs are located on a second sidewall adjacent the first sidewall and further wherein there are no ribs located above the upper label bumper on the second sidewall.

2. The plastic container of claim 1, wherein the second sidewall is symmetrical to an opposing side wall.

3. The plastic container of claim 1, wherein said vacuum panel comprises an upper and a lower edge, wherein said upper and lower edges are rounded.

4. The plastic container of claim 3, wherein the vacuum panel is substantially generally rectangular.

5. The plastic container of claim 1, wherein the first sidewall containing the vacuum panel has a width that is less than the width of the second sidewall.

6. The plastic container of claim 1, wherein the first plurality of ribs are concave.

7. The plastic container of claim 1, wherein the ribs in the second plurality of ribs located on the second sidewall are horizontal.

8. The plastic container of claim 1, wherein the first and second plurality of ribs and the vacuum panel cooperate to maintain container shape upon filling and cooling of the container.

9. The plastic container of claim 1, wherein the container is made of PET.

10. The plastic container of claim 1, wherein the container is hot-fillable.

11. The plastic container of claim 1, wherein the base is non-rounded.

12. The plastic container of claim 1, wherein at least one of said first and second plurality of ribs is inwardly facing.

13. The plastic container of claim 1, wherein the second plurality of ribs located on the second sidewall are inwardly facing ribs.

14. The plastic container of claim 1, further comprising an elliptical base push up.

15. The plastic container of claim 1, wherein said container is generally ovoid in cross-section.

16. The plastic container of claim 15, wherein said container is substantially rectangular.

17. A thin-walled, plastic container having a body portion, said body portion having generally rectangular sidewalls and a generally rectangular base having an elliptical base push up; wherein said body portion comprises a first plurality of ribs and a label mounting area extending between an upper label bumper and a lower label bumper on at least two of the adjacent rectangular sidewalls, said label mounting area comprising:

a vacuum panel on a first sidewall, wherein the first plurality of ribs are located above the upper label bumper and further wherein there are no ribs located below the upper label bumper on the first sidewall; and a second plurality of ribs positioned in the label area on a second sidewall adjacent the first sidewall, said ribs having inwardly facing rounded edges, relative to the interior of the container; and further wherein there are no ribs located above the upper label bumper on the second sidewall.

* * * * *